US008925466B2

(12) United States Patent
Reese et al.

(10) Patent No.: US 8,925,466 B2
(45) Date of Patent: Jan. 6, 2015

(54) BRAKE BEAM ASSEMBLY FOR A RAILWAY CAR TRUCK

(71) Applicant: Amsted Rail Company, Inc., Chicago, IL (US)

(72) Inventors: Nathan Reese, Troy, IL (US); Brad Myers, Lake Barrington, IL (US); Joseph Halford, St. Louis, MO (US)

(73) Assignee: Amsted Rail Company, Inc., Chicago, IL (US)

( * ) Notice: Subject to any disclaimer, the term of this patent is extended or adjusted under 35 U.S.C. 154(b) by 239 days.

(21) Appl. No.: 13/722,359

(22) Filed: Dec. 20, 2012

(65) Prior Publication Data

US 2014/0174318 A1 Jun. 26, 2014

(51) Int. Cl.
*B61H 13/36* (2006.01)
*B61F 5/50* (2006.01)

(52) U.S. Cl.
CPC . *B61H 13/36* (2013.01); *B61F 5/50* (2013.01)
USPC ..... 105/226; 105/182.1; 188/223.1

(58) Field of Classification Search
USPC ..... 105/226, 182.1, 200; 188/223.1, 233.3, 188/52, 209, 190, 207, 212, 202, 230, 210, 188/216
See application file for complete search history.

(56) References Cited

U.S. PATENT DOCUMENTS

| | | | | |
|---|---|---|---|---|
| 2,168,291 | A * | 8/1939 | Hedgcock | 188/207 |
| 2,519,896 | A * | 8/1950 | Ekholm | 188/221.1 |
| 2,729,311 | A * | 1/1956 | Barton et al. | 188/210 |
| 2,808,906 | A * | 10/1957 | Busch | 188/190 |
| 3,023,856 | A * | 3/1962 | Stewart | 188/210 |
| 5,682,964 | A * | 11/1997 | Murphy | 188/52 |
| 6,367,590 | B1 * | 4/2002 | Burke | 188/52 |
| 8,256,585 | B2 * | 9/2012 | Halford et al. | 188/233.3 |
| 8,668,059 | B2 * | 3/2014 | De La Fuente-Farias et al. | 188/233.3 |
| 2011/0259685 | A1 * | 10/2011 | De-La-Fuente-Farias et al. | 188/233.3 |
| 2012/0037033 | A1 * | 2/2012 | Halford et al. | 105/182.1 |
| 2014/0174317 | A1 * | 6/2014 | Wang | 105/200 |
| 2014/0174318 | A1 * | 6/2014 | Reese et al. | 105/226 |

* cited by examiner

*Primary Examiner* — Jason C Smith
(74) *Attorney, Agent, or Firm* — Edward J. Brosius

(57) ABSTRACT

A brake beam assembly for a railway car truck includes a brake beam mounted between opposed side frames of the railway car truck with opposite right hand and left hand ends. A strut is coupled to the brake beam and has opposite right hand and left hand ends coupled to the brake beam. Brake heads are coupled to the brake beam and struts proximate to the right hand and left hand ends thereof. Each brake head holds a brake shoe configured to engage a wheel of the railway car truck. Paddles extend from the brake heads. The paddles have distal ends configured to be received in wear liners in corresponding side frames of the railway car truck. A separation distance between the distal ends of the paddles is adjustable.

20 Claims, 7 Drawing Sheets

BRAKE BEAM ASSEMBLY FOR A RAILWAY CAR TRUCK

BACKGROUND OF THE INVENTION

The subject matter herein relates to a railway car truck and, more particularly, to a brake beam assembly for a railway car truck.

In a railway car truck, two axles are held in a pair of laterally spaced side frames, with a bolster extending laterally between and supported on each side frame. The wheels are press fit on the axles, with the ends of the axles also fitted with a roller bearing assembly. The roller bearing assembly is fit into a bearing adapter that is fit into a pedestal jaw opening at the longitudinal end of each side frame. To better control the stresses associated with heavy axle loads, the industry developed and implemented new standards for suspension systems on heavier cars. For example, heightened performance requirements have been implemented by the American Association of Railroads (AAR), such as those outlined in AAR M-976. AAR M-976 outlines the use of shear pads for the bearing adaptor. M-976 compliant railway car trucks reduce warping and side frame migration inward over time because the shear pads of the bearing adaptor provide an outward or restoring force to the side frames. However, both M-976 compliant railway car trucks and non-M-976 compliant railway car trucks are manufactured and in operation today.

Each railway car truck also includes a braking system having two brake beams that act to transmit braking force through brake shoes to the outer tread of the railway wheels. The brake beams are attached to the side frames in corresponding guide brackets having wear liners therein. For example, ends of the brake beams are received in the wear liners and are movable therein during application of the braking system.

During operation, the side frames tend to shift with respect to one another, such as when the railway car truck is going around a bend, or when the load supported by the railway car truck shifts or changes. The side frames may tend to shift inboard, which could squeeze in on the brake beam. As such, the brake beam is typically sized to create a gap or tolerance between the ends of the brake beams and the wear liners to avoid binding of the brake beams. However, such gap may be too wide in some situations, such as when the brake beam is off-center or kinked out of alignment, or when the brake beam used is undersized for the particular railway car truck. Additionally, for M-976 railway car trucks, because the shear pads of the bearing adaptor provide an outward or restoring force to the side frames, the side frames tend be separated by a greater distance than the standard or non-M-976 railway car trucks. When the gap is too wide, the brake beam is allowed to migrate within the pockets of the guide brackets and wear liners, which could lead to damage of the railcar wheels. For example, when the brake beam shifts over toward one side, the brake shoe and/or the brake head holding the brake shoe may begin to rub on the flange of the railway wheel, causing damage and/or failure of the railway wheel.

A need exists for an improved railway car truck that can compensate for conditions where the brake beam is too short or subject to being off-set.

BRIEF DESCRIPTION OF THE INVENTION

In one embodiment, a brake beam assembly for a railway car truck is provided including a brake beam configured to be mounted between opposed side frames of the railway car truck. The brake beam has opposite right hand and left hand ends. A strut is coupled to the brake beam and has opposite right hand and left hand ends coupled to the brake beam proximate to the right hand and left hand ends, respectively, of the brake beam. Brake heads are coupled to the brake beam and struts proximate to the right hand and left hand ends thereof. Each brake head holds a brake shoe configured to engage a wheel of the railway car truck. Paddles extend from the brake heads. The paddles have distal ends configured to be received in wear liners in corresponding side frames of the railway car truck. A separation distance between the distal ends of the paddles is adjustable.

Optionally, the relative positions of the distal ends of the paddles may be adjustable relative to the right hand and left hand ends of the brake beam. The paddles may be couplable to corresponding brake beams at multiple locations. The paddles may be formed integral with corresponding brake heads. The paddles may be separate and discrete from the brake heads and the brake beam. The paddles may be coupled to at least one of the brake beam, the strut and the corresponding brake heads using fasteners. A first separation distance may be defined for M-976 railway car trucks and a second separation distance may be defined for non-M-976 railway car trucks, the first separation distance being greater than the second separation distance.

Optionally, the brake beam may include a plurality of openings proximate to each of the right hand and left hand ends thereof. The openings may be positioned at different lateral distances from the corresponding ends. The paddles may be coupled to the brake beam using fasteners through selected openings to control positions of the paddles relative to the brake beam and to define the separation distance.

Optionally, the strut may include a plurality of openings proximate to each of the right hand and left hand ends thereof. The openings may be positioned at different distances from the corresponding ends. The paddles may be coupled to the strut using fasteners through selected openings to control positions of the paddles relative to the strut and to define the separation distance.

Optionally, paddles of different lengths may be selectively coupled to at least one of the brake beam, the strut and the corresponding brake heads to control positions of the paddles relative to each other to define the separation distance.

In another embodiment, a railway car truck is provided including a bolster having laterally opposite ends and two side frames transverse to the bolster and supporting the opposite ends of the bolster. Each side frame has a pedestal formed on longitudinally opposite ends thereof. Each side frame has a pair of guide brackets on an inner side of the side frame. Wear liners are received in corresponding guide brackets on the side frames. Two brake beam assemblies are supported on the bolster and side frames. Each brake beam assembly includes a brake beam configured to be mounted between opposed side frames of the railway car truck. The brake beam has opposite right hand and left hand ends. A strut is coupled to the brake beam and has opposite right hand and left hand ends coupled to the brake beam proximate to the right hand and left hand ends, respectively, of the brake beam. Brake heads are coupled to the brake beam and struts proximate to the right hand and left hand ends thereof. Each brake head holds a brake shoe configured to engage a wheel of the railway car truck. Paddles extend from the brake heads. The paddles have distal ends configured to be received in wear liners in corresponding side frames of the railway car truck. A separation distance between the distal ends of the paddles is adjustable.

In a further embodiment, a railway car truck is provided including a bolster having laterally opposite ends and two side frames transverse to the bolster and supporting the opposite ends of the bolster. Each side frame has a pedestal formed on longitudinally opposite ends thereof. Each side frame has a pair of guide brackets on an inner side of the side frame. Wear liners are received in corresponding guide brackets on the side frames. A bearing adapter is received in each pedestal opening. Each bearing adapter includes a concave opening to receive a bearing and a center section having a top surface generally opposite the concave opening. If the bearing adaptor includes an elastomeric adapter pad mounted on top of the bearing adapter then the railway car truck defines an M-976 railway car truck. If the bearing adaptor does not include an elastomeric adapter pad mounted on top of the bearing adapter then the railway car truck defines a non-M-976 railway car truck. The railway truck further includes two brake beam assemblies supported on the bolster and side frames. Each brake beam assembly includes a brake beam configured to be mounted between opposed side frames of the railway car truck. The brake beam has opposite right hand and left hand ends. A strut is coupled to the brake beam and has opposite right hand and left hand ends coupled to the brake beam proximate to the right hand and left hand ends, respectively, of the brake beam. Brake heads are coupled to the brake beam and struts proximate to the right hand and left hand ends thereof. Each brake head holds a brake shoe configured to engage a wheel of the railway car truck. Paddles extend from the brake heads. The paddles have distal ends received in corresponding wear liners. The paddles define a first separation distance between the distal ends of the paddles for M-976 railway car trucks and the paddles defining a second separation distance between the distal ends of the paddles for non-M-976 railway car trucks. The first separation distance is greater than the second separation distance. Optionally, the paddles may be adjustable relative to the brake beam to increase or decrease the separation distance between the distal ends of the paddles. The first separation distance may be between 70" and 71" and the second separation distance may be between 69" and 70".

DETAILED DESCRIPTION OF THE INVENTION

Figure 1:
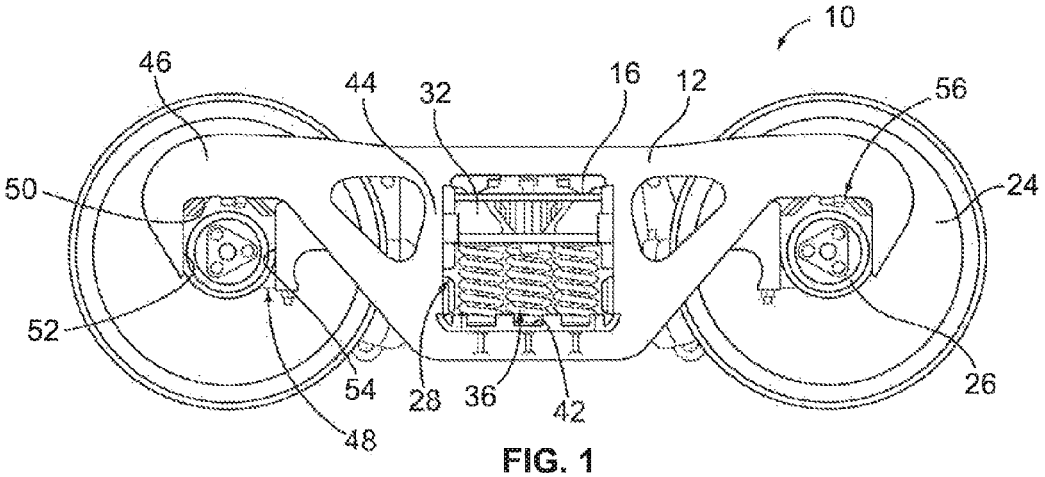
FIG. 1 is a side view of a railway car truck formed in accordance with an exemplary embodiment.
Figure 2:
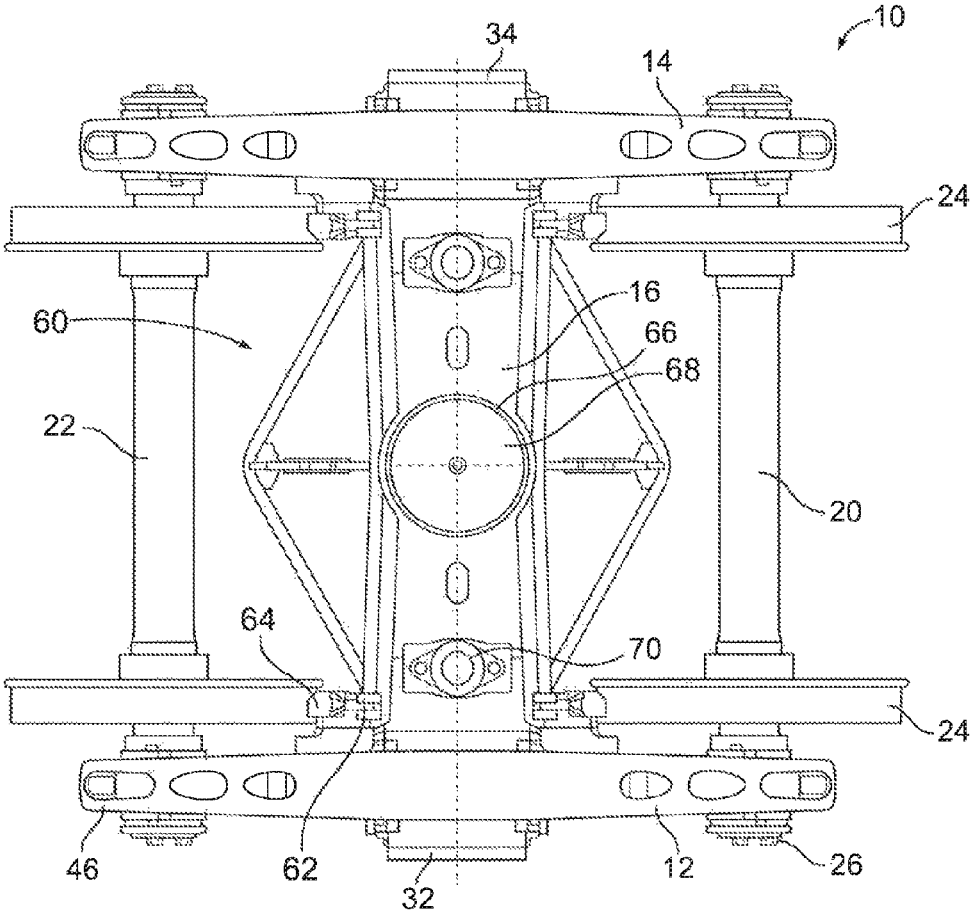
FIG. 2 is a top view of the railway car truck shown in FIG. 1.
Figure 3:
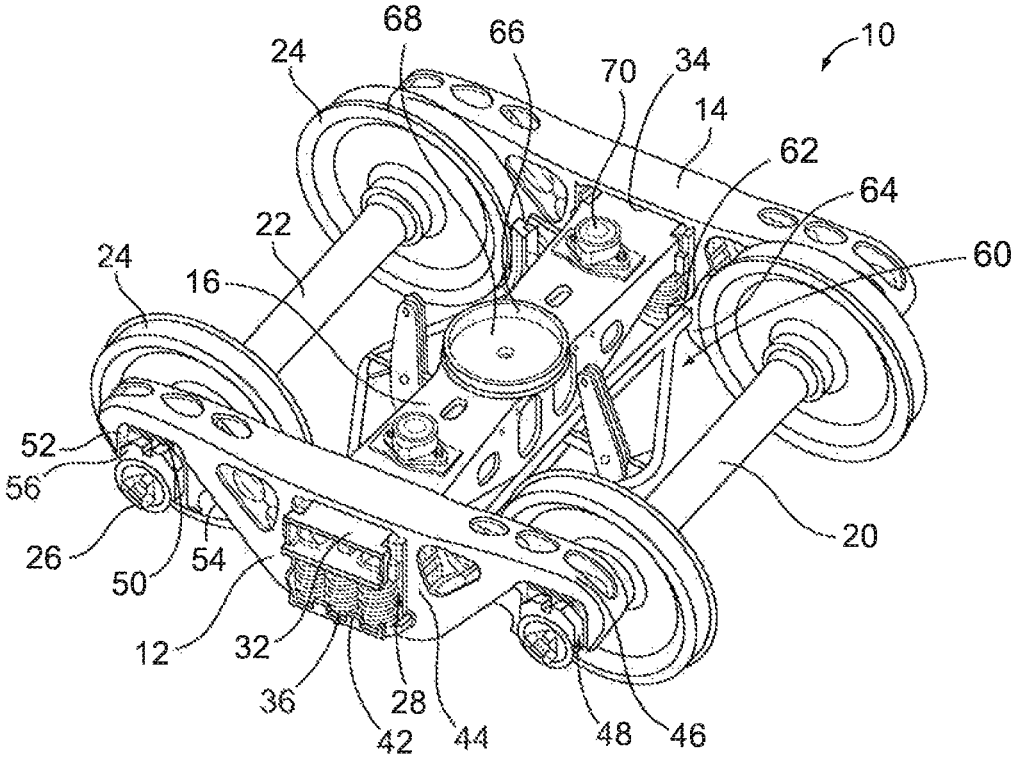
FIG. 3 is a perspective view of the railway car truck shown in FIG. 1.

Referring now to FIGS. 1-3, a railway car truck 10 is shown. The railway car truck 10 includes two laterally spaced side frames 12 and 14, between which a bolster 16 extends. Each of the side frames 12, 14 and bolster 16 are usually a cast steel unitary structure. Various internal ribs and supports lend strength, along with a savings in overall weight for each of such cast steel truck components.

Axles 20 and 22 extend laterally between the side frames 12, 14. Railway wheels 24 are press fit on the ends of the axles 20, 22. Roller bearing assemblies 26 are also provided on the ends of the axles 20, 22. The side frames 12, 14 include side frame openings 28 aligned with the bolster 16.

The bolster 16 is seen to include bolster ends 32 and 34, which extend through the side frame openings 28. Spring groups 36 support the bolster ends 32 on a side frame lower support 42. The side frames 12, 14 include vertical columns 44 that are longitudinally spaced and form the side frame openings 28 therebetween. The lower support section 42 has various raised structures adapted to position the spring group 36 thereupon.

The side frames 12, 14 are also seen to have laterally spaced pedestal jaws 46 which are the further most lateral extent of the side frames 12, 14. Each pedestal jaw 46 forms a pedestal jaw opening 48, which is comprised of a roof section 50, an outer wall 52, and an inner wall 54. The pedestal jaw opening 48 is adapted to receive a bearing adapter 56 therein, which is shown in further detail with reference to FIG. 4. The bearing adaptors 56 rest on the roller bearing assemblies 26.

The railway car truck 10 may have different types of bearing adaptors 56 depending on the age of the railway car truck 10, the application for the railway car truck 10, and the like. For example, newer and/or higher end railway car trucks 10 may include better suspension systems to better control the stresses associated with heavy axle loads. For example, heightened performance requirements have been implemented by the American Association of Railroads (AAR), such as those outlined in AAR M-976. M-976 compliant railway car trucks have shear pads on the bearing adaptors 56. M-976 compliant railway car trucks reduce warping or migration of the side frames 12, 14 inward over time because the shear pads of the bearing adaptors 56 provide an outward or restoring force to the side frames 12, 14. The side frames 12, 14 tend to remain further spaced apart from one another during use than non-M-976 railway car trucks, which include the bearing adaptors 56 but do not include the additional shear pads. The side frames 12, 14 of non-M-976 railway car trucks tend to migrate inward over time during use such that portions of the side frames 12, 14 are actually closer together then with M-976 railway car trucks.

The railway car truck 10 includes a brake system 60 having brake heads 62 that support brake shoes 64. The brake system 60 is operated to press the brake shoes 64 against the railway wheels 24. The brake heads 62 may be fabricated or cast steel devices. The brake system 60 is supported from the side frames 12, 14 and the bolster 16 and is illustrated with additional reference to FIG. 5. Because the brake system 60 is located between the side frames 12, 14, the lateral spacing between the side frames 12, 14 affects operation of the brake system 60. Conventional brake systems use the same components for both M-976 railway car trucks and for non-M-976 railway car trucks. However, because the side frames 12, 14 of non-M-976 railway car trucks tend to have less separation distance therebetween, the brake system may operate differently when used with non-M-976 railway car trucks as compared to M-976 railway car trucks. In an exemplary embodiment, the brake system 60 accommodates and compensates for the different lateral spacings of the side frames 12, 14 by having adjustable components or by using brake beams of different lengths depending on the particular lateral spacings of the side frames 12, 14. It is realized that M-976 railway car trucks and non-M-976 railway car trucks are one example of different railway car trucks having different side frame spacings, however the subject matter described herein may accommodate The bolster 16 includes on its upper surface a bolster center plate 66, which includes a bolster center plate wear liner 68. Also included on the upper surface of the bolster 16 is a pair of laterally spaced side bearings 70.

Figure 4:
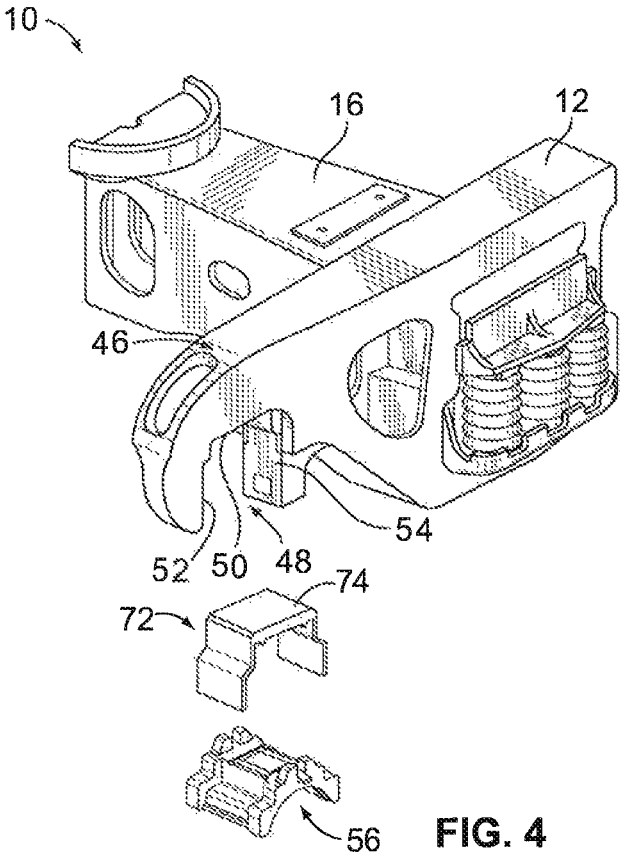
FIG. 4 is an exploded view of a portion of a railway car truck.

FIG. 4 is an exploded view of a portion of a railway car truck 10 showing a portion of the side frame 12 and a portion of the bolster 16. The pedestal jaw 46 and pedestal jaw opening 48 of the side frame 12 are illustrated in FIG. 4, showing the roof section 50, outer wall 52, and inner wall 54. The bearing adaptor 56 is shown poised for loading into the pedestal jaw opening 48. The bearing adapter 56 is configured to rest on the roller bearing assemblies 26 (shown in FIG. 1) and defines the interface between the roller bearing assemblies 26 and the side frames 12, 14.

The bearing adapter 56 is comprised of a unitary cast steel structure; however other materials and/or forming methods or processes are possible in alternative embodiments. The bearing adapter 56 includes a concave opening to receive the roller bearing assembly 26. The bearing adapter 56 includes a top surface 74 generally opposite the concave opening. In the illustrated embodiment, the bearing adapter assembly includes an adapter pad 72 for use with the bearing adaptor 56. The adapter pad 72 may be M-976 compliant so that the railway car truck 10 using the adapter pad 72 may be an M-976 railway car truck.

The adapter pad 72 is comprised of a cast or injection molded polymer or elastomer, such as a polyurethane, however other materials and/or forming methods or processes are possible in alternative embodiments. The adapter pad 72 is mounted on the top surface 74 of the bearing adapter 56. The adapter pad 72 protects the side frame pedestal jaw from wear. Additionally, the adapter pad 72 takes up longitudinal clearance between the bearing adapter 56 and the pedestal jaw 46. For example, the adapter pad 72 allows a snug fit of the bearing adapter 56 within the pedestal jaw opening 48. The adapter pad 72 functions as a shear pad to provide suspension for the side frame 12 and the roller bearing assembly 26. The adapter pad 72 allows the buildup of stored energy during railway car curving resulting from pad deflection, such as through compression of the legs and/or shear of the top section. Curving refers to the situation when the wheel sets take the necessary radial position (normally parallel axles develop an angle between them) during movement down the railway track, such as along a curved section of the railway track, which may occur through a combination of longitudinal and lateral axle translation. The adapter pad 72 stores the energy and helps the wheel set return to a proper position after curving by releasing the stored energy when the car exits the curve. The adapter pad 72 provides a centering mechanism to keep the axles parallel on straight track. The adapter pad 72 may attenuate vertical wheel impacts. The adapter pad 72 may improves bearing load distribution to help extend bearing component life.

In alternative embodiments, the railway car truck 10 may be usable without the adapter pad 72. In such embodiments, an appropriately shaped bearing adapter 56 is received in the pedestal jaw opening 48 without the adapter pad 72 therebetween. The railway car truck 10 without the use of an adapter pad may be referred to as a non-M-976 railway car truck.

Figure 5:
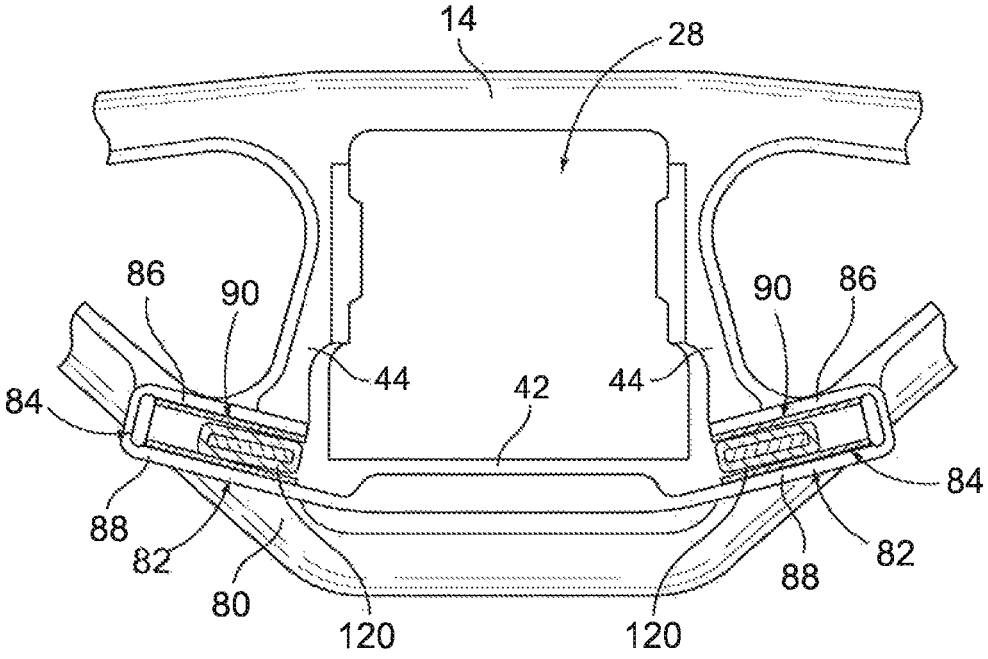
FIG. 5 is a side view of a portion of the railway car truck.

FIG. 5 is a side view of a portion of the railway car truck 10 illustrating a portion of an inner side 80 of the side frame 14. The side frame 14 includes guide brackets 82 extending inward from the side frame 14. Optionally, the guide brackets 82 are integrally formed with the side frame 14. The guide brackets 82 are positioned along the vertical column 44 proximate to the side frame opening 28. The guide brackets 82 are positioned proximate to the lower support section 42 on each side of the side frame opening 28. Similarly, the side frame 12 (shown in FIGS. 2 and 3) includes a pair of guide brackets that are substantially similar to the guide brackets 82.

Each guide bracket 82 includes a pocket 84 that is surrounded by an upper wall 86 and a lower wall 88. The upper and lower walls 86, 88 are substantially parallel to one another and project from the side frame 14 to define the pocket 84. In an exemplary embodiment, the guide bracket 82 has an open side furthest from the side frame 14 that provides access to the pocket 84. The open side extends between the upper and lower walls 86, 88. The pocket 84 receives a wear liner 90 which receives a portion of the brake system 60 (shown in FIG. 3). For example, the wear liners 90 receive paddles 120 of the brake system 60 as described in further detail below. In an exemplary embodiment, the guide brackets 82 may conform to AAR standard S-366. The AAR standards call for the guide bracket 82 to be inclined to the horizontal at an angle of 14° for 40, 50, 70, and 90-100 ton cars, and at an angle of 16° for 125 ton cars.

Figure 6:
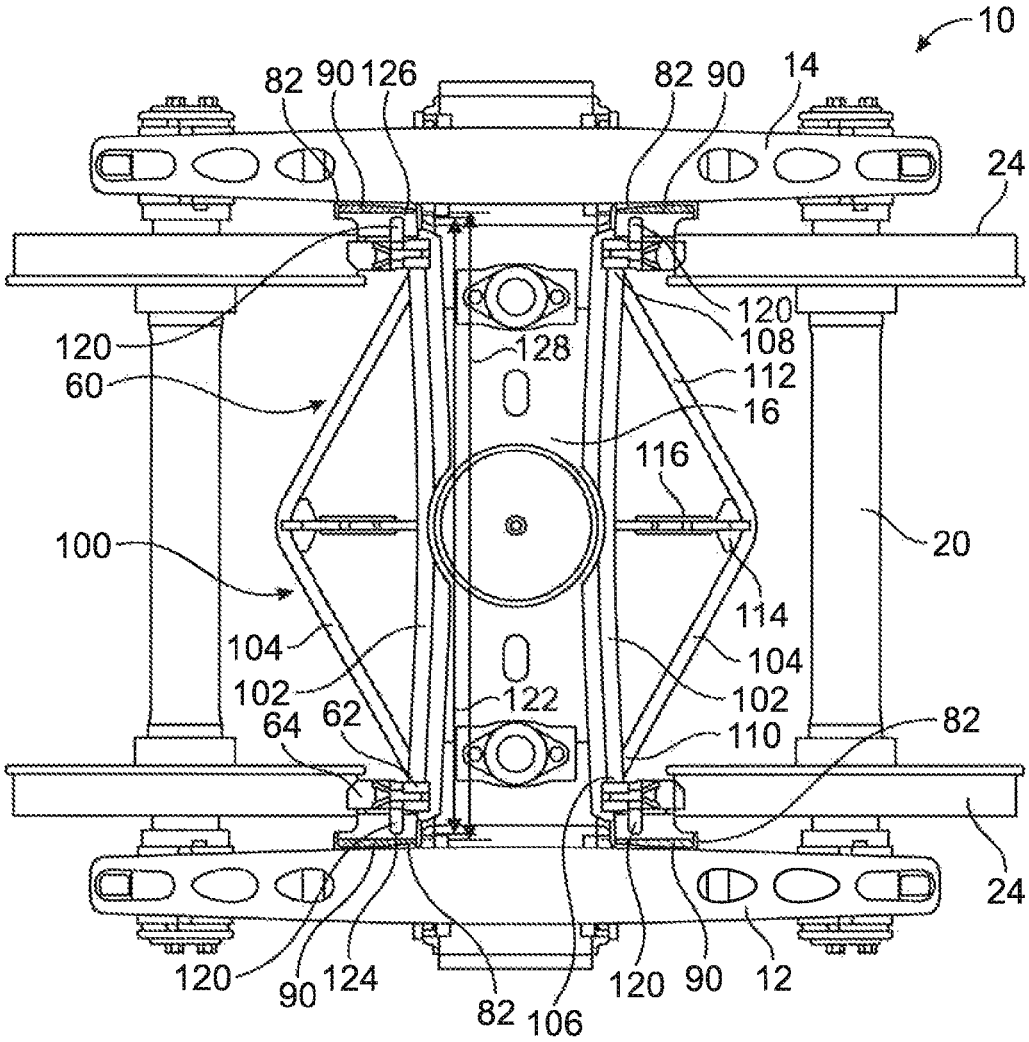
FIG. 6 is a top, partial sectional view of a portion of the railway car truck.

FIG. 6 is a top, partial sectional view of a portion of the railway car truck 10 illustrating wear liners 90 received in corresponding guide brackets 82 of the side frames 12, 14. FIG. 6 also illustrates a portion of the bolster 16, the railway wheels 24 and a portion of the brake system 60. The brake system 60 includes brake beam assemblies 100 each including a brake beam 102, a strut 104, and brake heads 62 coupled to ends of the brake beam 102 and strut 104.

The brake beam 102 is generally elongated between a right hand end 106 and a left hand end 108. The brake beam 102 extends laterally between the side frames 12, 14. The brake shoes 64 are coupled to the brake heads 62, which are provided proximate to the ends 106, 108 of the brake beam 102, generally aligned with the railway wheels 24.

The strut 104 includes a right hand end 110 and a left hand end 112. The strut 104 is coupled to the brake beam 102 with the ends 110, 112 proximate to the ends 106, 108, respectively. The strut 104 extends at acute angles from the brake beam 102 to an apex at a center portion. A standoff section 114 extends from a center portion of the brake beam 102 to the apex of the strut 104. The brake beam 102, strut 104 and standoff section 114 are typically comprised of structural steel, and may be in the form of a hollow structural steel sections. One or more levers 116 are connected to the brake beam assembly 100, such as to the standoff sections 114, to actuate the brake beam assembly 100 during braking.

The wear liners 90 are shown loaded into the guide brackets 82. Ends of the brake beam assembly 100 are configured to extend into the wear liners 90. For example, paddles 120 extend from the opposite ends of the brake beam assembly 100 that are configured to extend into the wear liners 90. The paddles 120 may be integrally formed with the brake heads 62. Alternatively, the paddles 120 may be integrally formed with the brake beam 102. In other alternative embodiments, the paddles 120 may be separate and discrete from, the other components of the brake beam assembly 100. For example, the paddles 120 may be coupled, such as fastened, to the brake beam 102, the strut 104 and/or the corresponding brake head 62.

During operation of the brake system 60, the brake beam assemblies 100 may be pressed toward the corresponding railway wheels 24 to apply braking pressure to the railway wheels 24. The levers 116 actuate the brake assemblies 100 during braking. Movement of the brake beam assemblies 100 is guided by the wear liners 90. For example, the wear liners 90 limit movement of the brake beams 102 along a generally linear path toward, and away from, the railway wheels 24. The brake beams 102 have a linear range of motion defined by the wear liners 90.

A separation distance 122 is defined between opposite distal ends 124, 126 of the paddles 120. The separation distance 122 may be less than a separation distance 128 between the wear liners 90 to resist binding or other engagement with the wear liners 90. In an exemplary embodiment, the separation distance 122 may be controlled based on the separation distance 128. For example, for railway car trucks having narrower separation distances 128 the separation distances 122 between the paddles 120 may be decreased accordingly, whereas for railway car trucks having wider separation distances 128 the separation distances 122 between the paddles 120 may be increased accordingly. The separation distance 122 may be designed to be a measured distance or a fractional percentage smaller than the separation distance 128. Depending on the type of railway car truck, the separation distance 122 may be different. For example, for non-M-976 railway car trucks, the separation distance 122 may be a certain distance, such as approximately 69.5". For example, AAR S-345 maintains that the separation distance be between 69.25" and 69.6875". However, for M-976 railway car trucks, because the adapter pads 72 tend to maintain the side frames 12, 14 in a wider orientation than non-M-976 railway car trucks, the brake beam assembly 100 for use with the M-976 railway car trucks may have an increased separation distance 122 as compared to the separation distance 122 for the non-M-976 railway car trucks. For example, for the M-976 railway car trucks, the separation distance 122 may be between approximately 70.1875" and 70.6875". Such separation distance 122 is greater than the maximum separation distance set forth in AAR S-345, however the longer distance, when used on M-976 compliant railway car trucks that have reduced warping or migration of the side frames 12, 14 inward over time, is acceptable and leads to improved brake beam orientation and operation. For example, less lateral shifting of the brake beam 102 occurs. Risk of accidental disengagement from the wear liner 90 is reduced. Better centering of the brake beam 102 is accomplished and therefore better positioning of the brake shoes 64 relative to the wheels 24 may be accomplished, thus reducing damage to the railway wheels 24.

In an exemplary embodiment, the paddles 120 are adjustable to control the separation distance 122 between the distal ends 124, 126. The relative positions of the distal ends 124, 126 of the paddles 120 are adjustable relative to the right hand end 106 and the left hand end 108 of the brake beam 102. The paddles 120 may be adjustable with the brake heads 62. For example, the paddles 120 may be integral with the brake heads 62 and variably positionable along the brake beam 102 with the brake heads 62. The position of the brake head 62 and paddle 120 relative to the side frame 12 or 14 may thus be changed, such as to correspond to an M-976 or a non-M-976 railway car truck.

Figure 7A:
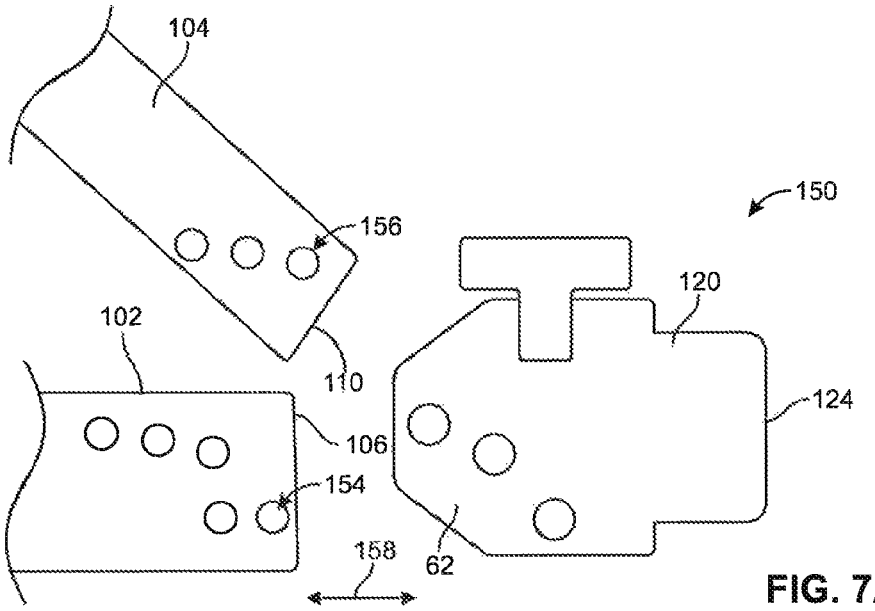
FIG. 7*a* illustrates a portion of a brake system for the railway car truck showing an adjustable brake head and paddle unit.
Figure 7B:
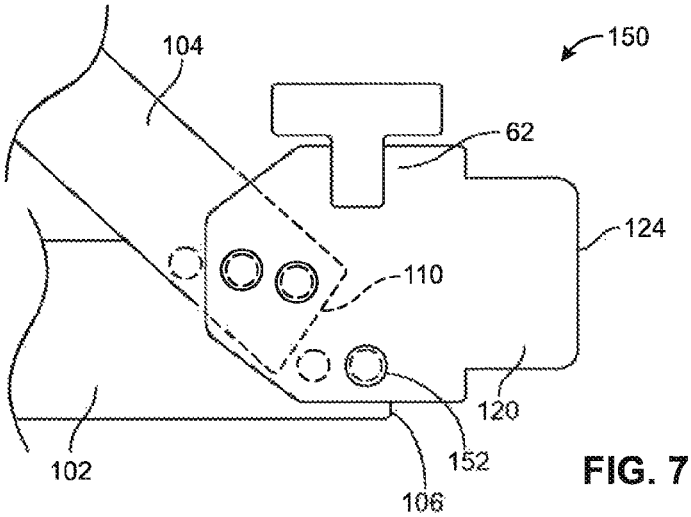
FIG. 7*b* illustrates the brake head and paddle unit shown in FIG. 7*a* in a first mounting arrangement.
Figure 7C:
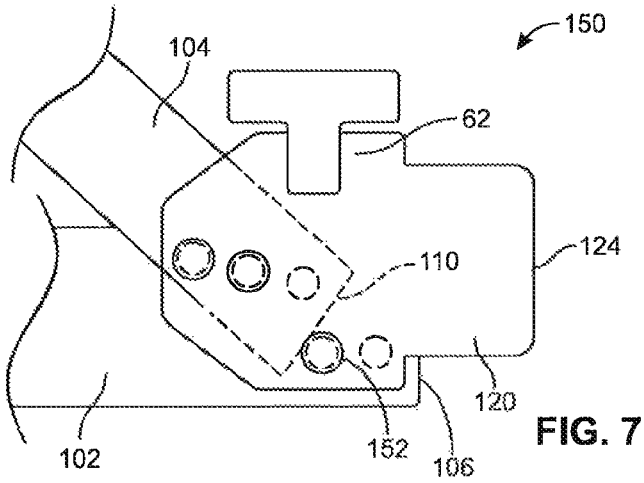
FIG. 7*c* illustrates the brake head and paddle unit shown in FIG. 7*a* in a second mounting arrangement.

FIG. 7*a* illustrates a portion of the brake system 60 showing an adjustable brake head and paddle unit 150. FIG. 7*b* illustrates the brake head and paddle unit 150 in a first mounting arrangement. FIG. 7*c* illustrates the brake head and paddle unit 150 in a second mounting arrangement. The brake head and paddle unit 150 includes the brake head 62 and the paddle 120. The paddle 120 is integral with the brake head 62. The brake head and paddle unit 150 is configured to be coupled to the brake beam 102 and/or the strut 104 at multiple locations. In an exemplary embodiment, the brake head and paddle unit 150 is coupled to both the brake beam 102 and the strut 104.

The brake head and paddle unit 150 is coupled using fasteners 152 extending through openings 154 in the brake beam 102 and openings 156 in the strut 104. Other securing means or fixtures may be used in alternative embodiments, such as welding. In an exemplary embodiment, the brake beam 102 includes multiple openings 154 proximate to the end 106 thereof. The openings 154 are laterally offset at different depths from the end 106 to control a lateral position (in a lateral direction 158) of the brake head and paddle unit 150 relative to the brake beam 102. The strut 104 may include multiple openings 156 proximate to the end 110 thereof. The openings 156 are laterally offset at different depths from the end 106 to control a lateral position of the brake head and paddle unit 150 relative to the strut 104. The offsets of the openings 154, 156 may be any amount, such as approximately 0.5".

Depending on the mounting location of the brake head and paddle unit 150 to the brake beam 102 and strut 104, the position of the distal end 124 of the paddle 120 may be controlled. The brake head and paddle unit 150 thus defines an adjustable brake beam assembly. For example, the paddle 120 may be shifted outward (FIG. 7*b*) when a longer brake beam assembly is needed, such as with M-976 railway car trucks, and the paddle 120 may be shifted inward (FIG. 7*c*) when a shorter brake beam assembly is needed, such as with non-M-976 railway car truck.

Figure 8A:
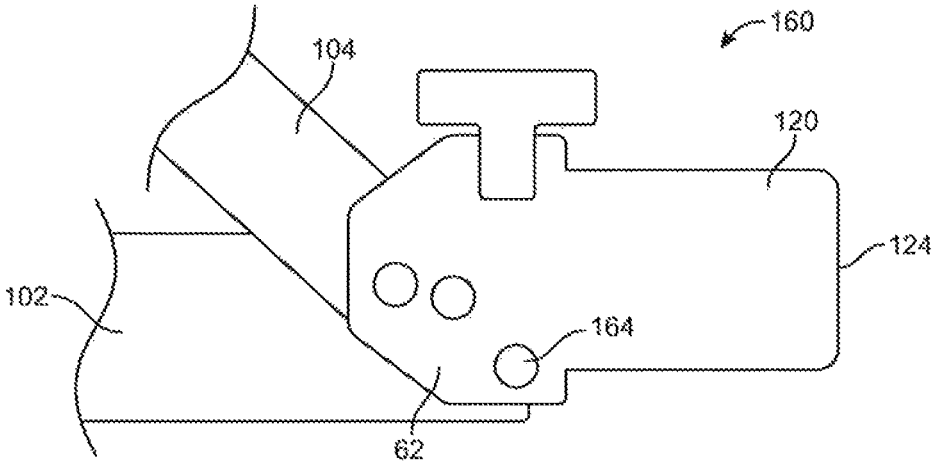
FIGS. 8*a* and 8*b* illustrate a portion of a brake system for the railway car truck showing an adjustable brake head and paddle unit.
Figure 8B:
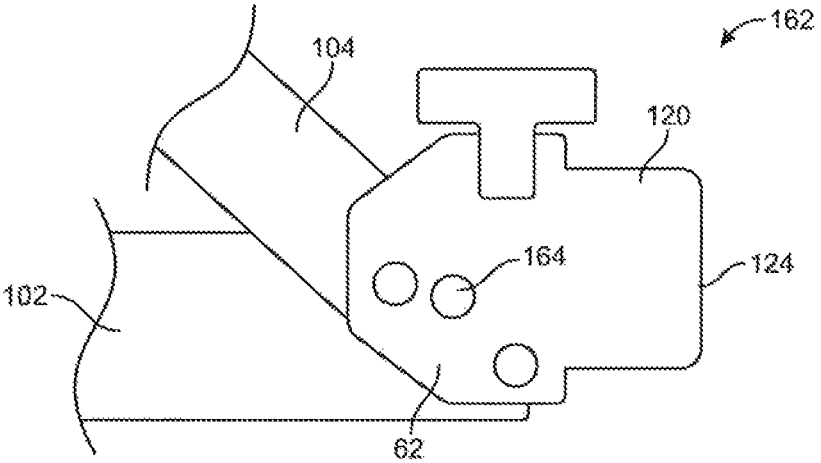

FIGS. 8*a* and 8*b* illustrate a portion of the brake system 60 showing adjustable brake head and paddle units 160, 162, respectively. The brake head and paddle units 160, 162 are similar to one another, however the paddle 120 extending from the brake head and paddle unit 162 is longer than the paddle 120 extending from the brake head and paddle unit 160. The brake head and paddle units 160, 162 both include paddles 120 that are integral with the brake head 62, however the paddles are of different lengths. The brake head and paddle units 160, 162 are configured to be coupled to the brake beam 102 and/or the strut 104, such as using fasteners 164 extending through openings in the brake beam 102 and the strut 104. Other securing means or fixtures may be used in alternative embodiments, such as welding.

Depending on which brake head and paddle unit 160 or 162 is used, the position of the distal end 124 of the paddle 120 may be controlled. The brake head and paddle units 160, 162 thus define an adjustable brake beam assembly. For example, the brake head and paddle unit 162 may be used when a longer brake beam assembly is needed, such as with M-976 railway car trucks, and the brake head and paddle unit 160 may be used when a shorter brake beam assembly is needed, such as with non-M-976 railway car truck.

Figure 9A:
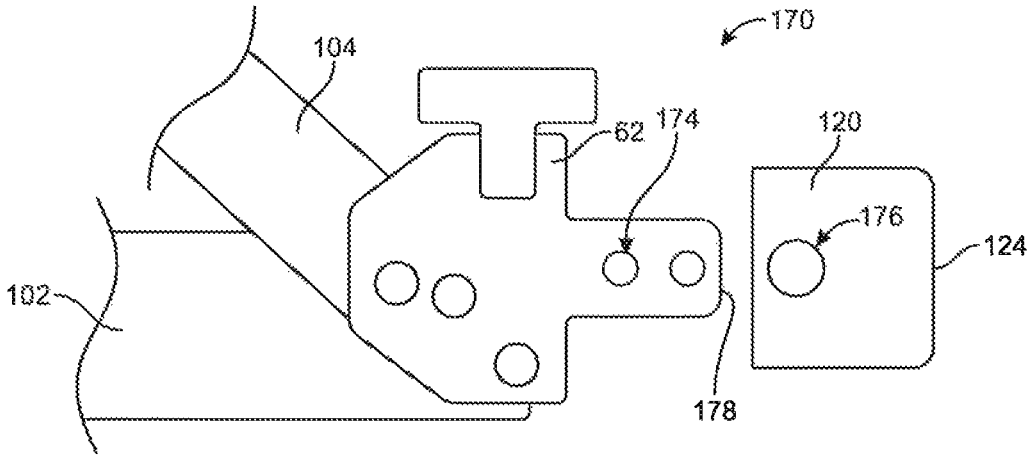
FIG. 9*a* illustrates a portion of a brake system for the railway car truck showing an adjustable brake head and paddle unit.
Figure 9B:
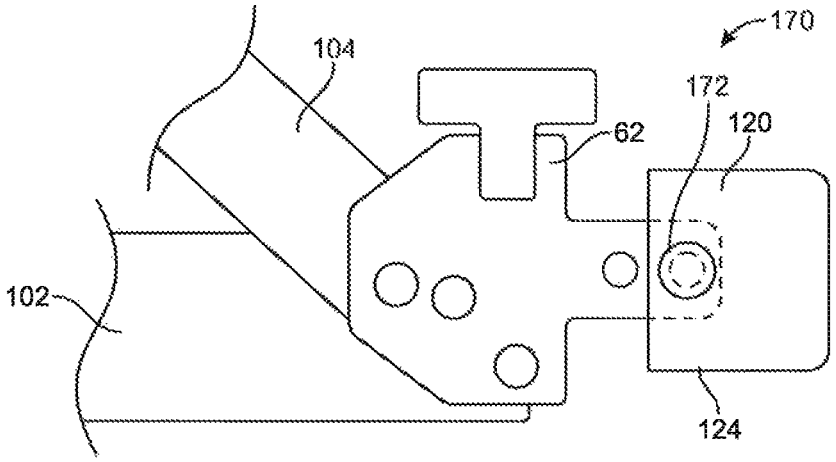
FIG. 9*b* illustrates the brake head and paddle unit shown in FIG. 9*a* in a first mounting arrangement.
Figure 9C:
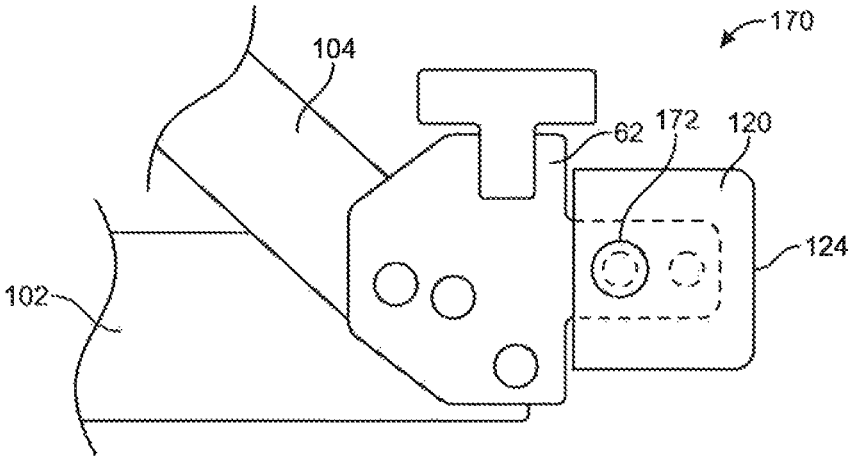
FIG. 9*c* illustrates the brake head and paddle unit shown in FIG. 9*a* in a second mounting arrangement.

FIG. 9*a* illustrates a portion of the brake system 60 showing an adjustable brake head and paddle unit 170. The brake head and paddle unit 170 includes the brake head 62 and the paddle 120. The paddle 120 is separate and discrete from the brake head 62. In an exemplary embodiment, the brake head 62 is coupled to both the brake beam 102 and the strut 104. The paddle 120 is configured to be coupled to the brake head 62 at multiple locations to control a position of the distal end 124 of the paddle 120 relative to the brake beam 102. FIG. 9*b* illustrates the brake head and paddle unit 170 in a first mounting arrangement. FIG. 9*c* illustrates the brake head and paddle unit 170 in a second mounting arrangement.

The paddle 120 is coupled to the brake head 62 using fasteners 172 extending through an opening 174 in the brake head 62 and an opening 176 in the paddle 120. Other securing means or fixtures may be used in alternative embodiments, such as welding. In an exemplary embodiment, the brake head 62 includes multiple openings 174 proximate to an end 178 thereof. The openings 174 are laterally offset at different depths from the end 178 to control a lateral position of the paddle 120 relative to the brake head 62. The offsets of the openings 174 may be any amount, such as approximately 0.5".

Depending on the mounting location of the paddle 120 to the brake head 62, the position of the distal end 124 of the paddle 120 may be controlled. The brake head and paddle unit 170 thus defines an adjustable brake beam assembly. For example, the paddle 120 may be shifted outward when a longer brake beam assembly is needed, such as with M-976 railway car trucks, and the paddle 120 may be shifted inward when a shorter brake beam assembly is needed, such as with non-M-976 railway car truck.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A brake beam assembly for a railway car truck, the brake system comprising:

a brake beam configured to be mounted between opposed side frames of the railway car truck, the brake beam having opposite right hand and left hand ends;

a strut coupled to the brake beam, the strut having opposite right hand and left hand ends coupled to the brake beam proximate to the right hand and left hand ends, respectively, of the brake beam;

brake heads coupled to the brake beam and struts proximate to the right hand and left hand ends thereof, each brake head holding a brake shoe configured to engage a wheel of the railway car truck; and paddles extending from the brake heads, the paddles having distal ends being configured to be received in wear liners in corresponding side frames of the railway car truck, a separation distance between the distal ends of the paddles being adjustable.

2. The brake beam assembly of claim 1, wherein the relative positions of the distal ends of the paddles are adjustable relative to the right hand and left hand ends of the brake beam.

3. The brake beam assembly of claim 1, wherein the paddles are couplable to the corresponding brake beams at multiple locations.

4. The brake beam assembly of claim 1, wherein the paddles are formed integral with corresponding brake heads.

5. The brake beam assembly of claim 1, wherein the paddles are separate and discrete from the brake heads and the brake beam, the paddles being coupled to at least one of the brake beam, the strut and the corresponding brake heads using fasteners.

6. The brake beam assembly of claim 1, wherein the brake beam includes a plurality of openings proximate to each of the right hand and left hand ends thereof, the openings being positioned at different distances from the corresponding ends, the paddles being coupled to the brake beam using fasteners through selected openings to control positions of the paddles relative to the brake beam and to define the separation distance.

7. The brake beam assembly of claim 1, wherein the strut includes a plurality of openings proximate to each of the right hand and left hand ends thereof, the openings being positioned at different distances from the corresponding ends, the paddles being coupled to the strut using fasteners through selected openings to control positions of the paddles relative to the strut and to define the separation distance.

8. The brake beam assembly of claim 1, wherein the paddles of different lengths are selectively coupled to at least one of the brake beam, the strut and the corresponding brake heads to control positions of the paddles relative to each other to define the separation distance.

9. The brake beam assembly of claim 1, wherein a first separation distance is defined for M-976 railway car trucks and a second separation distance is defined for non-M-976 railway car trucks, the first separation distance being greater than the second separation distance.

10. A railway car truck comprising:

a bolster having laterally opposite ends;

two side frames transverse to the bolster and supporting the opposite ends of the bolster, each side frame having a pedestal formed on longitudinally opposite ends thereof, each side frame having a pair of guide brackets on an inner side of the side frame;

wear liners received in corresponding guide brackets on the side frames;

two brake beam assemblies supported on the bolster and side frames, each brake beam assembly comprising:

a brake beam mounted between the side frames, the brake beam having opposite right hand and left hand ends;

a strut coupled to the brake beam, the strut having opposite right hand and left hand ends coupled to the brake beam proximate to the right hand and left hand ends, respectively, of the brake beam;

brake heads coupled to the brake beam and struts proximate to the right hand and left hand ends thereof, each brake head holding a brake shoe configured to engage a wheel of the railway car truck; and paddles extending from the brake heads, the paddles having distal ends received in corresponding wear liners, a separation distance between the distal ends of the paddles being adjustable.

11. The railway car truck of claim 10, wherein the relative positions of the distal ends of the paddles are adjustable relative to the right hand and left hand ends of the brake beam.

12. The railway car truck of claim 10, wherein the paddles are couplable to the corresponding brake beams at multiple locations.

13. The railway car truck of claim 10, wherein the paddles are formed integral with corresponding brake heads.

14. The railway car truck of claim 10, wherein the brake beam includes a plurality of openings proximate to each of the right hand and left hand ends thereof, the openings being positioned at different distances from the corresponding ends, the paddles being coupled to the brake beam using fasteners through selected openings to control positions of the paddles relative to the brake beam and to define the separation distance.

15. The railway car truck of claim 10, wherein the strut includes a plurality of openings proximate to each of the right hand and left hand ends thereof, the openings being positioned at different distances from the corresponding ends, the paddles being coupled to the strut using fasteners through selected openings to control positions of the paddles relative to the strut and to define the separation distance.

16. The railway car truck of claim 10, wherein the paddles of different lengths are selectively coupled to at least one of the brake beam, the strut and the corresponding brake heads to control positions of the paddles relative to each other to define the separation distance.

17. The railway car truck of claim 10, wherein a first separation distance is defined for M-976 railway car trucks and a second separation distance is defined for non-M-976 railway car trucks, the first separation distance being greater than the second separation distance.

18. A railway car truck comprising:

as bolster having laterally opposite ends;

two side frames transverse to the bolster and supporting the opposite ends of the bolster, each side frame having a pedestal formed on longitudinally opposite ends thereof, each side frame having a pair of guide brackets on an inner side of the side frame;

wear liners received in corresponding guide brackets on the side frames;

a bearing adapter received in each pedestal opening, each bearing adapter comprising a concave opening to receive a bearing and a generally rectangular center section having a top surface generally opposite the concave opening, wherein if the bearing adaptor includes an elastomeric adapter pad mounted on top of the bearing adapter then the railway car truck defines an M-976 railway car truck, and wherein if the bearing adaptor does not include an elastomeric adapter pad mounted on top of the bearing adapter then the railway car truck defines a non-M-976 railway car truck;

two brake beam assemblies supported on the bolster and side frames, each brake beam assembly comprising:

a brake beam mounted between the side frames, the brake beam having opposite right hand and left hand ends;

a strut coupled to the brake beam, the strut having opposite right hand and left hand ends coupled to the brake beam proximate to the right hand and left hand ends, respectively, of the brake beam;

brake heads coupled to the brake beam and struts proximate to the right hand and left hand ends thereof; each brake head holding a brake shoe configured to engage a wheel of the railway car truck; and paddles extending from the brake heads, the paddles having distal ends being received in corresponding wear liners, the paddles defining a first separation distance between the distal ends of the paddles for M-976 railway ear trucks and the paddles defining a second separation distance between the distal ends of the paddles for non-M-976 railway car trucks, the first separation distance being greater than the second separation distance.

19. The railway car truck of claim 18, wherein the paddles are adjustable relative to the brake beam to increase or decrease the separation distance between the distal ends of the paddles.

20. The railway car truck of claim 18, wherein the first separation distance is between 70" and 71" and wherein the second separation distance is between 69" and 70".

* * * * *